US006729393B2

(12) United States Patent
Vincent et al.

(10) Patent No.: US 6,729,393 B2
(45) Date of Patent: May 4, 2004

(54) ZERO DRILL COMPLETION AND PRODUCTION SYSTEM

(75) Inventors: Ray Vincent, Cypress, TX (US); Steve Geste, Jakarta (ID)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/126,397

(22) Filed: Apr. 19, 2002

(65) Prior Publication Data

US 2002/0166665 A1 Nov. 14, 2002

Related U.S. Application Data

(63) Continuation-in-part of application No. 09/539,004, filed on Mar. 30, 2000.

(51) Int. Cl.[7] ..... E21B 33/16

(52) U.S. Cl. ..... 166/177.4; 166/319; 166/332.1; 166/317

(58) Field of Search ..... 166/177.4, 153, 166/156, 316, 318, 332.1, 319, 317

(56) References Cited

U.S. PATENT DOCUMENTS

| | | | | |
|---|---|---|---|---|
| 3,270,814 | A | 9/1966 | Richardson et al. | 166/21 |
| 3,768,562 | A | 10/1973 | Baker | 166/289 |
| 4,105,069 | A | 8/1978 | Baker | 166/31 |
| 4,602,684 | A | 7/1986 | Van Wormer et al. | 166/285 |
| 5,024,273 | A | 6/1991 | Coone et al. | 166/289 |
| 5,117,910 | A | 6/1992 | Brandell et al. | 166/291 |
| 5,497,840 | A | 3/1996 | Hudson | 175/72 |
| 5,598,890 | A | 2/1997 | Richard et al. | 166/276 |
| 5,738,171 | A | 4/1998 | Szarka | 166/289 |
| 5,746,274 | A | 5/1998 | Voll et al. | 166/278 |
| 5,960,881 | A | 10/1999 | Allamon et al. | 166/291 |

FOREIGN PATENT DOCUMENTS

| | | |
|---|---|---|
| GB | 2360802 A1 | 3/2001 |
| WO | WO 97/15748 | 5/1997 |

*Primary Examiner*—John Kreck
(74) *Attorney, Agent, or Firm*—Madan Mossman & Sriram, P.C.

(57) ABSTRACT

Apparatus for a one trip completion of fluid production wells. A completion tool string includes a pressure activated cementing valve, an external casing packer, a pressure activated production valve, an opening plug and a plug landing collar and a closing plug and seat. This tool series is assembled near the end of a production tube string upstream of the well production screen.

8 Claims, 6 Drawing Sheets

ZERO DRILL COMPLETION AND PRODUCTION SYSTEM

CROSS-REFERENCE TO RELATED APPLICATION

The present application is a Continuation-In-Part of U.S. Utility patent application Ser. No. 09/539,004, filed Mar. 30, 2000.

BACKGROUND OF THE INVENTION

1. Field of the Invention

The present invention relates to petroleum production wells. More particularly, the invention relates to well completion and production methods and apparatus.

2. Description of the Prior Art

The process and structure by which a petroleum production well is prepared for production involves the steps of sealing the production zone from contamination and securing production flow tubing within the well borehole. These production zones are thousands of feet below the earth's surface. Consequently, prior art procedures for accomplishing these steps are complex and often dangerous. Any procedural or equipment improvements that eliminate a downhole "trip", is usually a welcomed improvement.

Following the prior art, production tube setting and opening are separate "trip" events. After a well casing is secured by cementing, a production string is then positioned where desired within the borehole and the necessary sealing packers set. In some cases, the packers are set by fluid pressure internally of the tubing bore. After the packers are set, a cementing circulation valve in the production tube assembly is opened by tubing bore pressure, for example, and annulus cement is pumped into position around the production tubing and above the production zone upper seal packer.

This procedure leaves a section of cement within the tubing below the cementing valve that blocks the upper tubing bore from production flow. The blockage is between the upper tubing bore and the production screen at or near the terminal end of the tubing string. Pursuant to prior art practice, the residual cement blockage is usually removed by drilling. A drill bit and supporting drill string must be lowered into the well, internally of the production tubing, on a costly, independent "trip" to cut away the blockage.

SUMMARY OF THE INVENTION

An objective of the present invention is to position well production tubing within the wellbore, secure the tubing in the well by cementing, and open the tubing to production flow in one downhole trip. In pursuit of this and other objectives to hereafter become apparent, the present invention includes a production tubing string having the present well completion tool assembly attached above the production screen and casing shoe.

This completion tool assembly includes an alignment of four basic tools in serial downhole order. At the uphole end of the alignment is a pressure actuated cementing valve followed by an external casing packer. Below the casing packer is a pressure actuated production valve and below the production valve is a bore plug landing collar With the tubing string downhole and the open hole production screen located at the desired position within the well production zone, an opening plug is deposited in the tubing bore at the surface and pumped down the tubing bore by water, other well fluid or finishing cement until engaging a plug landing collar. Upon engaging the landing collar, the plug substantially seals the tubing bore to facilitate dramatic pressure increases therein. Actuated by a pressure increase within the tubing bore column, the external casing packer is expanded to block the borehole space annulus between the raw borehole wall and the packer body. An additional increase in pressure slides the opening sleeve of the pressure activated cementing valve into alignment of the internal and external circulation ports. Upon alignment of the circulation ports, tubing bore fluid such as cement is discharged through the ports into the wellbore annulus space. Due to the presence of the expanded external casing packer below the circulation ports, the annulus cement must flow uphole and around the tubing above the packer.

When the desired quantity of cement has been placed in the tubing bore at the surface, the fluidized cement within the tubing bore column is capped by a closing pump-down plug. Water or other suitable well fluid is pumped against the closing plug to drive most of the cement remaining in the tubing bore through the circulation ports into the annulus. At the circulation port threshold, the closing plug engages a plug seat on the closing sleeve of the pressure actuated cementing valve. With a first pumped pressure increase acting on the fluid column above the closing plug seat, the cementing valve closing sleeve slides into a circulation port blocking position.

With the circulation port closed, a second pressure increase that is normally greater than the first develops a force on the plug seat of such magnitude as to shear calibrated retaining screws that hold the seat ring within the tubing bore. When structurally released from the tubing bore wall, the closing plug and plug seat impose a piston load on the short cement column supported by the opening plug and plug landing collar. This column load is converted to fluid pressure on the pressure activated production valve to force a fluid flow opening through the valve. When the pressure activated production valve opens, the residual cement column is discharged through the open valve below the packer.

Although the residual cement column is discharged into the production zone bore, the absolute volume of cement dispersed into the bore is insignificant.

As the closing plug is driven by the finishing fluid through the central bore of the production valve past the valve opening, the finishing fluid, water or light solvent, rushes through the valve opening to flush it of residual cement and debris. At this point, a clear production flow path from the production zone into the production tubing bore is open. When pressure on the finishing fluid is released, upflowing production fluid sweeps the residual finishing fluid out of the tubing bore ahead of the production fluid flow.

BRIEF DESCRIPTION OF THE DRAWINGS

A detailed description of the invention following hereafter refers to the several figures of the drawings wherein like reference characters in the several figures relates to the same or similar elements throughout the several figures and.

DETAILED DESCRIPTION OF PREFERRED EMBODIMENTS

Figure 1:
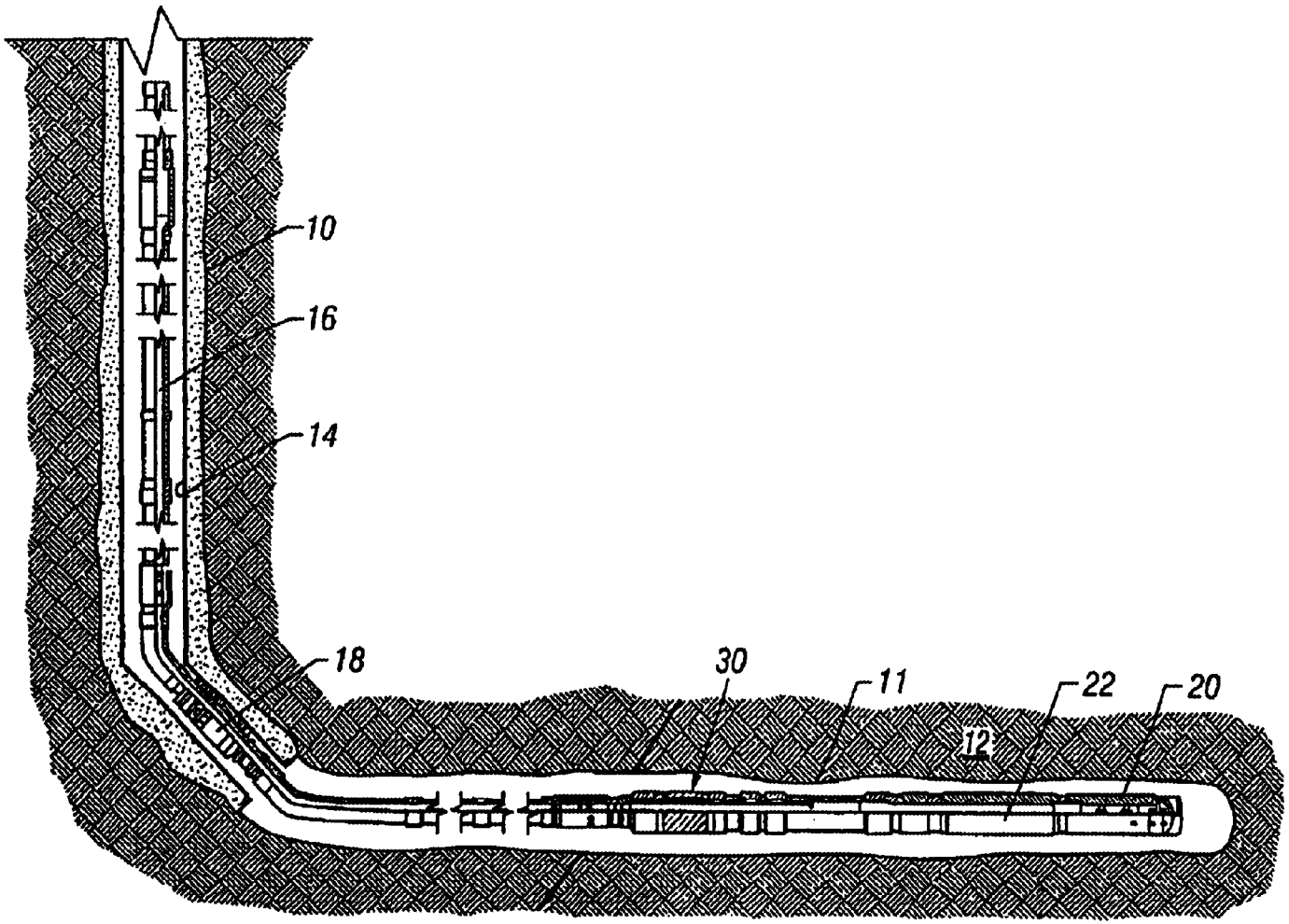
FIG. 1 is a schematic well having the present invention in place for completion and production.

The invention utility environment is represented by the schematic of FIG. 1 which illustrates a well bore 10 that is normally initiated from the earth's surface in a vertical direction. By means and procedures well known to the prior art, the vertical well bore may be continuously transitioned into a horizontal bore orientation 11 as desired for bottom hole location or the configuration of the production zone 12. Usually, a portion of the vertical surface borehole 10 will be internally lined by steel casing pipe 14 which is set into place by cement in the annulus between the inner borehole wall and the outer surface of the casing 14.

Valuable fluids such as petroleum and natural gas held within the production zone 12 are efficiently conducted to the surface for transport and refining through a string of production tube 16. Herein, the term "fluid" is given its broadest meaning to include liquids, gases, mixtures and plastic flow solids. In many cases, the annulus between the outer surface of the production tube 16 and the inner surface of the casing 14 or raw well bore 10 will be blocked with a production packer 18. The most frequent need for a production packer 18 is to shield the lower production zone 12 from contamination by fluids drained along the borehole 10 from higher zones and strata.

The terminal end of a production string 16 may be an uncased open hole but is often equipped with a liner or casing shoe 20 and a production screen 22. In lieu of a screen, a length of drilled or slotted pipe may be used. The production screen 22 is effective to grossly separate particles of rock and earth from the desired fluids extracted from the formation 12 structure as the fluid flow into the inner bore of the tubing string 16. Accordingly, the term "screen" is used expansively herein as the point of well fluid entry into the production tube.

Pursuant to practice of the present invention, a production string 16 is provided with the present well completion tool assembly 30. The tool assembly is positioned in the uphole direction from the production screen 22 but is often closely proximate therewith. As represented by FIG. 1, the production packer 18 (if necessary), the completion tool assembly 30, the production screen 22 and the casing shoe 20 are preassembled with the production tube 16 as the production string is lowered into the wellbore 10.

Figure 2:
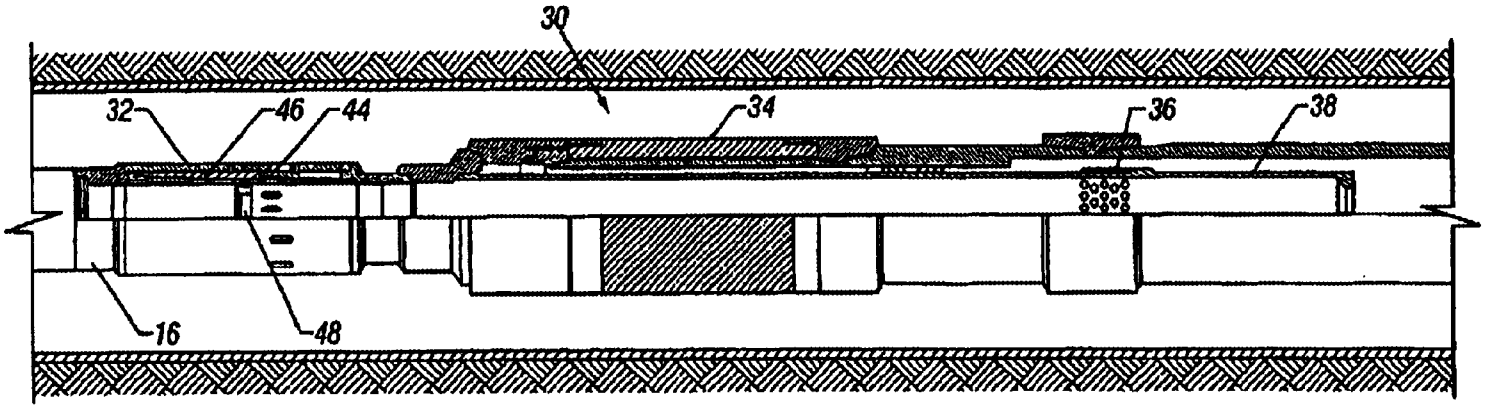
FIG. 2 is a partial section of the present well completion tool assembly in the run-in condition.

With respect to FIG. 2, the completion tool assembly 30 comprises a pressure activated cementing valve 32, an external casing packer 34, a pressure activated production valve 36 and a plug landing collar 38. Each of these devices may be known to those of ordinary skill in some modified form or applied combination.

Figure 3:
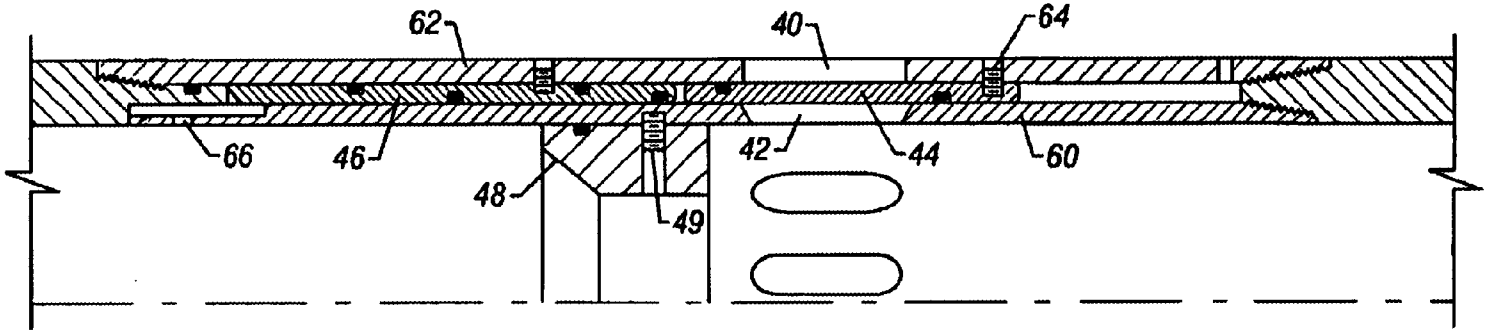
FIG. 3 is a partial section detail of the cementing valve run-in setting.
Figure 5:
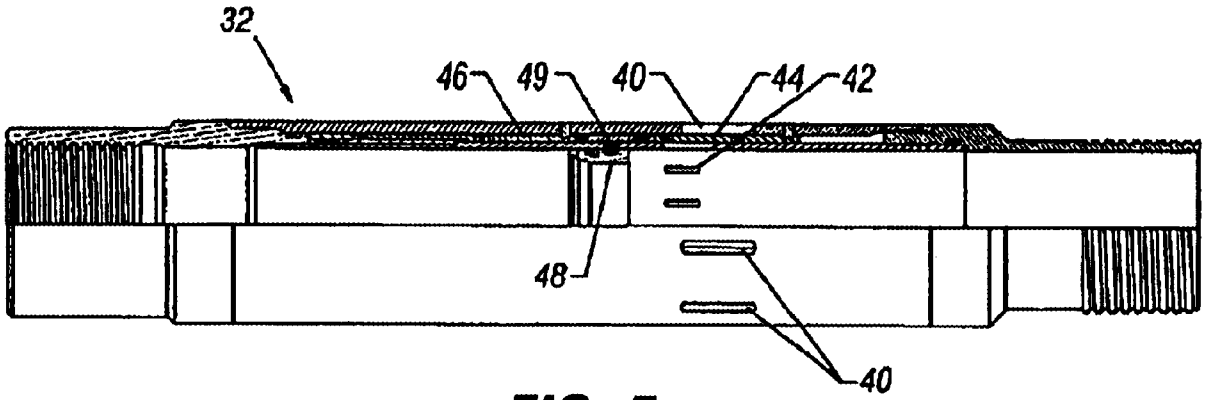
FIG. 5 is a partial section of a closed, pressure actuated cementing valve.

As shown in greater detail by FIG. 3, the pressure actuated cementing valve provides circulation ports 40 and 42 through the inside bore wall 60 of the tool and the outer tool casing 62. Axially sliding sleeve 44 is initially positioned to obstruct a fluid flow channel between the inner ports 42 and the outer ports 40. This position is secured by a calibrated set-screw 64, for example, for a well run-in setting. Upon a satisfactory down-hole location, the sleeve 44 is positionally displaced, as shown in by FIGS. 6 and 7, by high fluid pressure applied within the tool flow bore from fluid circulation pumps. Force of the fluid pressure shears the retainer screw 64 to allow displacement of the sleeve 44 from the initial obstruction position between the flow parts 40 and 42. When the ports 40 and 42 are mutually open, well cement may be pumped from within the internal bore of the tool and tubing string through the ports 40 and 42 into the well annulus around the tubing string. Use of the term "cement" herein is intended to describe any substance having a fluid or plastic flow state that may be pumped into place and thereafter induced to solidify.

Figure 9:
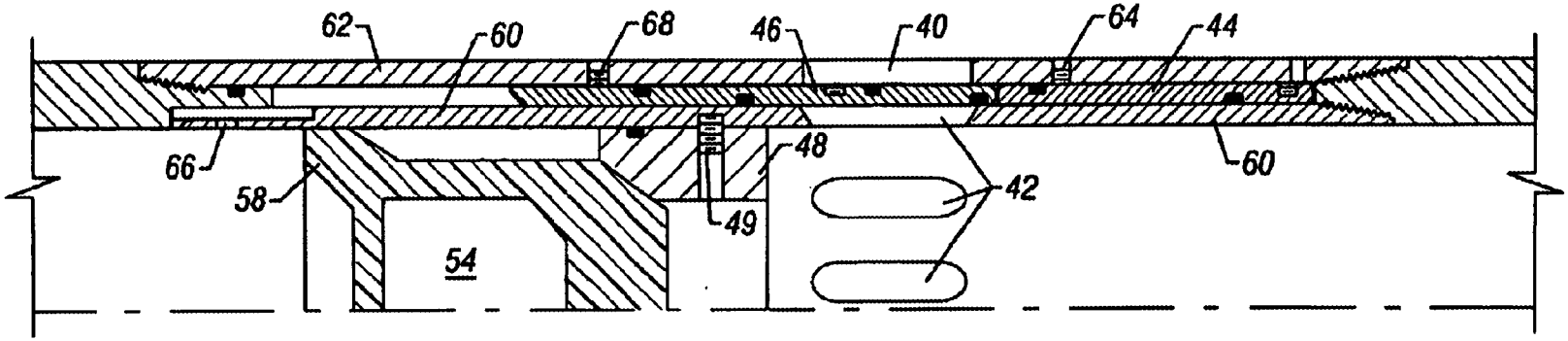
FIG. 9 is a partial section detail of the closed cementing valve.
Figure 8:
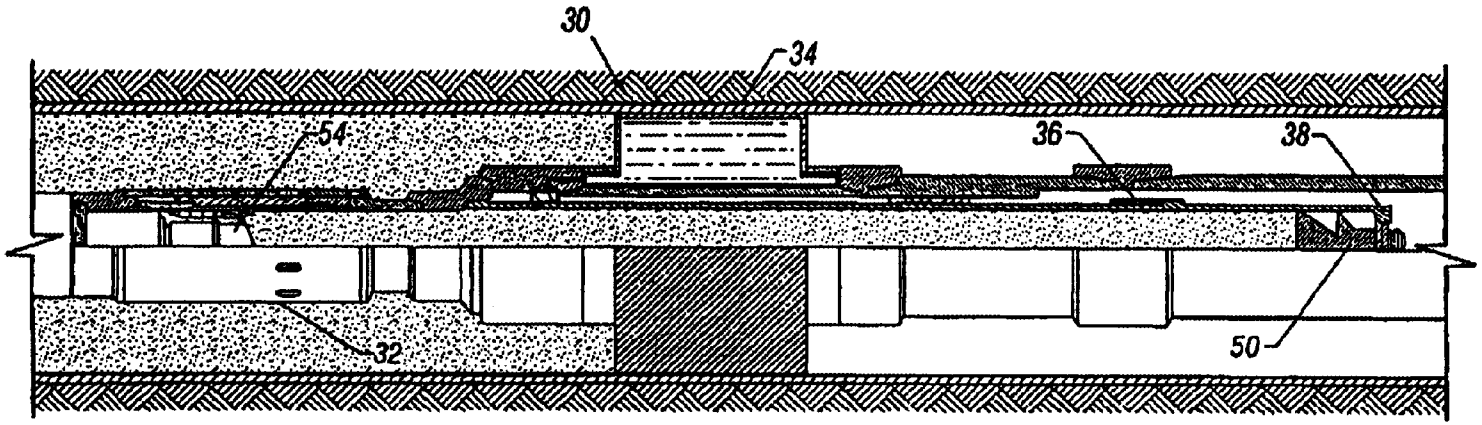
FIG. 8 is a partial section of the present well completion tool assembly in the cement termination condition.

Closure of the fluid channel through ports 40 and 42 is accomplished by a second sliding sleeve 46 as illustrated by FIGS. 8 and 9. A landing seat 48 for a closure plug 54 is secured to the inside bore wall of the tool by shear screws 49, for example. Procedurally, the cement slurry tail is capped by a wiper closing plug 54. The closing plug is pumped by water or other suitable well working fluid down the tubing string bore until engaging the plug landing seat 48. When the plug engages the seat 48, fluid pressure in the bore may be increased to 1000 psi, for example, within the tool flow bore. Such pressure is admitted through fluid ports 66 against the end area of closing sleeve 46. Force of the pressure shears the retainer screw 68 and shifts the sleeve 46 against the sleeve 44 and between the circulation ports 40 and 42. Additional pressure against the closing plug and seat 48, 5000 psi, for example is operative to shear the assembly screws 49 and drive the plug 54 and seat 48 further along the tool bore.

The external casing packer 34 is any device that creates a seal in the wellbore annulus around the tube string. A common example of a casing packer provides an expansible elastomer boot around an internal tube body. An internal bore of the tube body is coaxially connected with the production tube string. The expansible boot is secured to the tube body around the perimeter of the two circumferential edges of the boot. A fluid tight chamber is thereby provided between the boot edges and between the tube body and the inside surface of the expansible boot. This chamber is connected by a check valve controlled conduit to the interior bore of tube body. Hence, pressurized fluid within tube body expands the boot against the casing or borehole wall.

Figure 11:
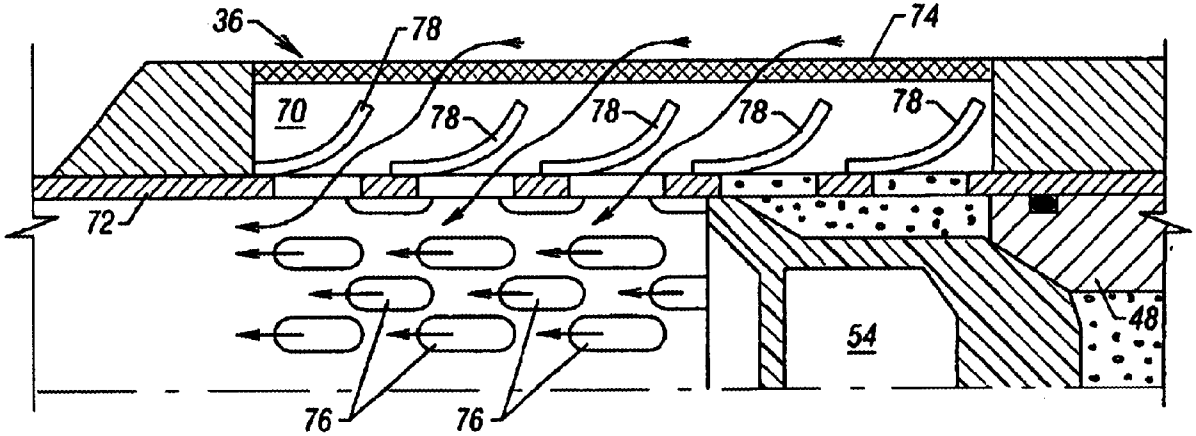
FIG. 11 is a partial section detail of the pressure actuated production valve.

A simplified example of a pressure actuated production valve 36 is shown by FIG. 11 to include an annular chamber 70 between an internal bore wall 72 and an external jacket 74. The external jacket 74 may be slotted pipe or a screen to pass the desired fluid flow. The internal bore wall is perforated by a plurality of apertures 76 distributed along the axial length of the bore wall. These apertures 76 are initially closed by a fluid pressure displaced fluid flow obstacle such as a sliding sleeve similar to the sleeve 44 in the cement valve. Alternatively, the aperture 76 may be initially closed by reed members 78 shown by FIG. 11 as having a frangible assembly with the internal bore wall 72. A predetermined magnitude of fluid pressure within the tool flow bore partially ruptures the reed 78 connections to the bore wall 72 to bend the reeds 78 to a fixed open position.

The plug landing collar 38 may be an extension of the production valve sleeve that continues an open flow continuity of this tool flow bore through a plug seat 56.

Figure 4:
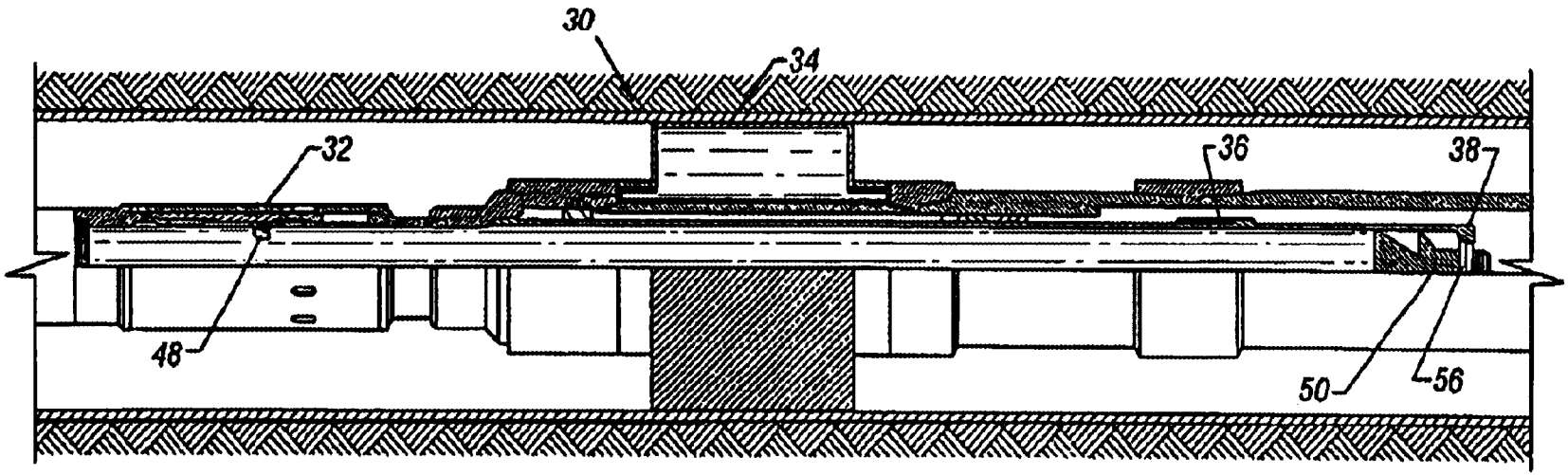
FIG. 4 is a partial section of the present well completion tool assembly in the packer inflation condition.

The above described tubing string assembly is lowered into the well bore 10 with the packer 18 unset and the external casing packer 34 deflated. The cementing valve 32 ports 40 and 42 are closed as shown in FIG. 3. The production flow screen 22 is positioned where desired and an opening pump-down plug 50 is placed in the tubing string bore to be pumped by well finishing cement down to the landing collar 38 for engagement with the plug seat 56 as shown by FIG. 4. If desired, the plug 50 may also be transferred downhole by water or other well working fluid. With the plug 50 secure upon the landing collar plug seat 56, fluid pressure within the tubing bore is increased against the opening plug 50 to inflate the packer 34. This event blocks the well annulus between the production screen 22 and the cementing valve 32.

Figure 6:
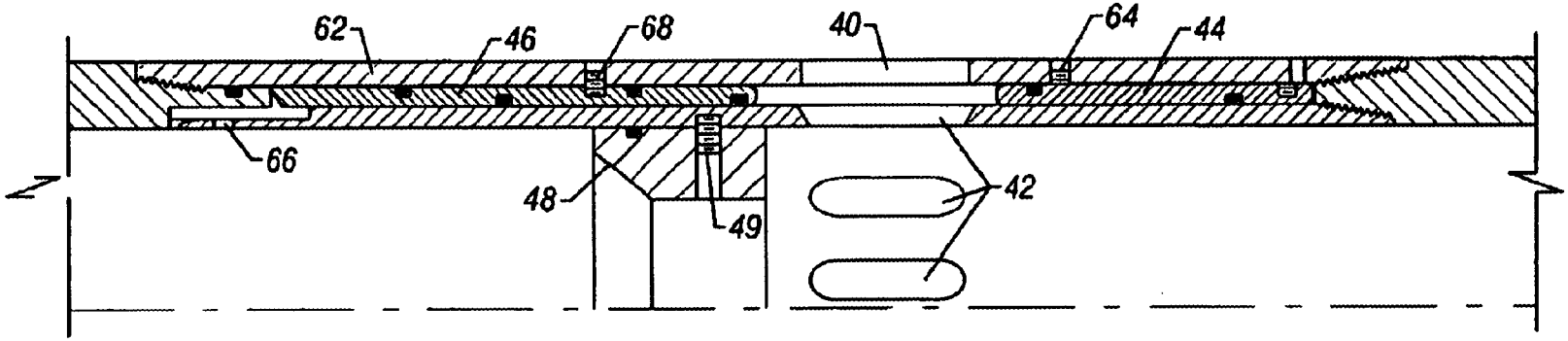
FIG. 6 is a partial section detail of the open cementing valve.
Figure 7:
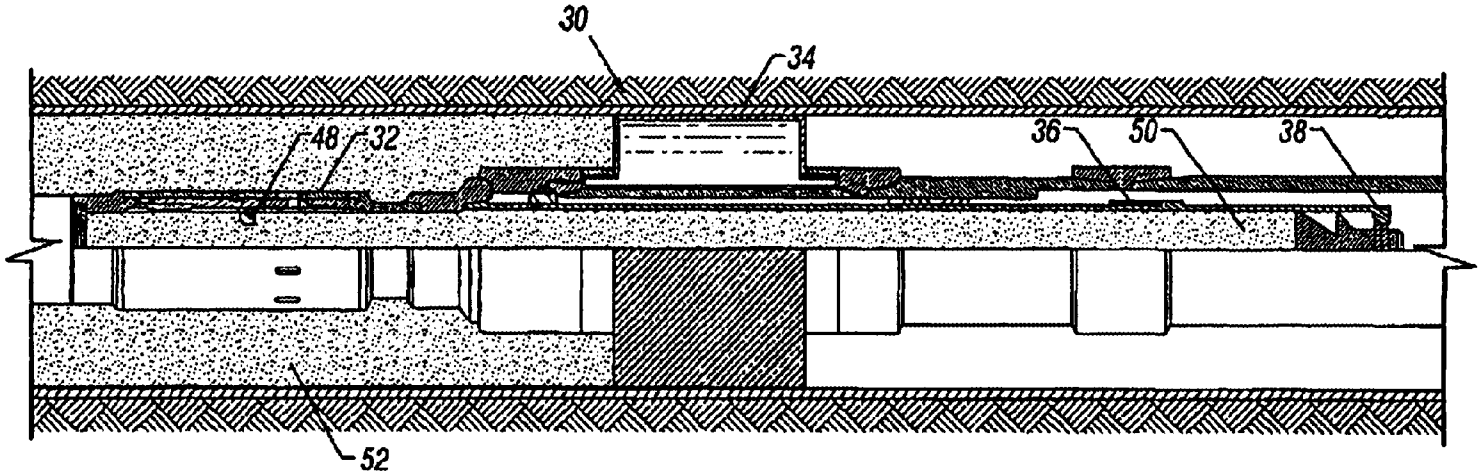
FIG. 7 is a partial section of the present well completion tool assembly in the annulus cementing condition.

Next, fluid pressure within the tubing bore is further increased to shift the cementing valve 32 opening sleeve 44 by shearing the set screw 64, as shown by FIG. 6. Shifting the opening sleeve 44 opens a flow channel through the circulation ports 40 and 42. When the circulation port channel opens, cement flows through the channel and up the borehole annulus around the production tubing as shown by FIGS. 6 and 7.

The total cement volume requirement for a particular well is usually calculated with considerable accuracy. Accordingly, when the desired quantity of cement has been pumped into the tubing bore, a closing pump-down plug 54 is placed in the bore to cap the cement column. Behind the closing pump-down plug 54, water or other suitable well working fluid is pumped to complete the cement transfer and settle the closing pump-down plug 54 against the cementing valve plug seat 48. With the tool flow bore closed by the plug 54, the flow bore pressure may be increased behind the plug. An increase of tubing bore pressure to 1000 psi, for example, against the plug 54 and seat 48 causes a shift in the valve closing sleeve 46 thereby closing the fluid communication ports 40 and 42. Illustrated by FIG. 9, fluid pressure enters the sliding sleeve annulus through pressure port 66 to bear against the end of the closing sleeve 46. When sufficient, the pressure force shears the screw 68 and moves the sleeve 46 between the ports 40 and 42.

Figure 10:
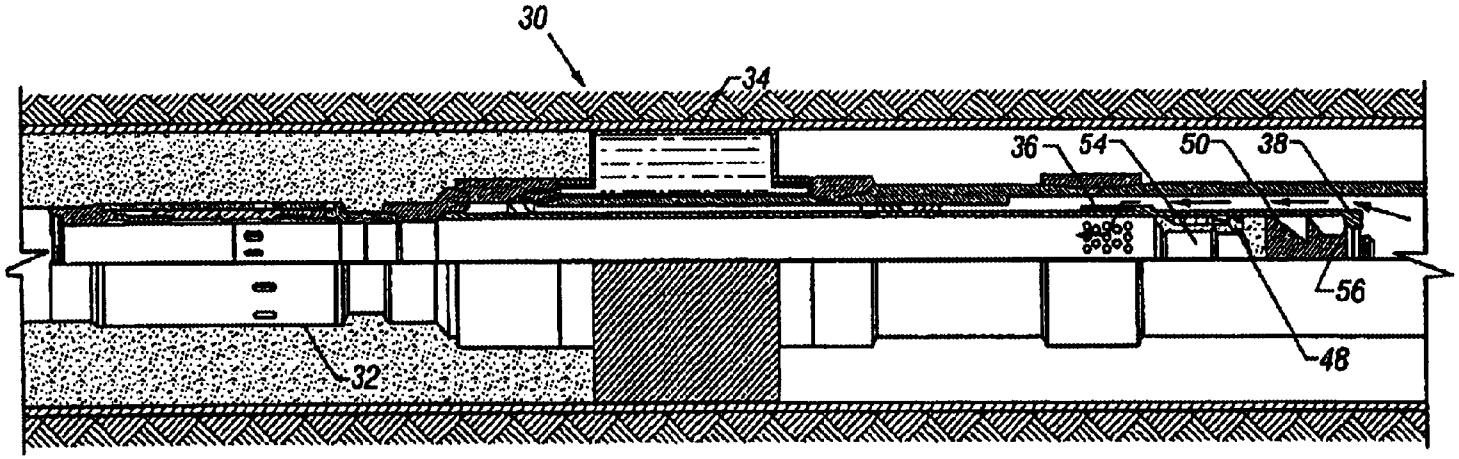
FIG. 10 is a partial section of the present well completion tool assembly in the production flow opening condition.

Thereafter, the tubing bore pressure is increased again, to 5000 psi, for example, to shear the plug seat retaining screws 49 and release both the seat 48 and the closing plug 54. When released, the free piston nature of the plug and seat unit drives against the residual cement column that was isolated between the opening pump-down plug 50 and the closing pump-down plug 54. Pressure against the closing pump-down plug 54 is thereby transferred to the residual cement column and consequently to the pressure activated production valve 36. Referring to FIGS. 10 and 11, this increased pressure against the production valve 36 ruptures flow port closure reeds 78 to permanently open the flow ports 76 between a production flow annulus and the tubing bore. Continued pressure against the residual cement column purges the residual cement through the newly opened production valve ports 76 into the well bore below the packer 34.

It will be understood by those of skill in the art that the number and distribution of the flow ports 76 is configured to bridge the length of the plug 54 whereby cement and well working fluid may simultaneously exit the flow port 56 into the wellbore as plug 54 passes the open flow ports as illustrated by FIG. 11.

Another active mechanism in the process of opening the production valve 36 is the seal bias of the plug 54 bore sealing fin 58. The wiping bias of the fin 58 is oriented to seal uphole fluid pressure within the production tube bore from passing between the fin and tubing wall. Conversely, when the static pressure within the wellbore is greater than the static pressure in the production tube bore, the plug 54 sealing fin bias will allow wellbore fluid flow past the fin 58 into the production tube bore. Hence, it is not essential for the plug 54 to be pressure driven past the flow port 76 opening.

At this point, the well completion process is essentially complete and the well is ready to produce. However, some operators may choose to transfer a cement contamination fluid into the production zone bore to assure a subsequent removal of the residual column cement from the well bore.

Having fully described the preferred embodiments of the present invention, various modifications will be apparent to those skilled in the art to suit the circumstances of a particular well and manufacturing capacity. It is intended that all variations within the scope and spirit of the appended claims be embraced by the foregoing disclosure.

What is claimed:

1. A well completion tool comprising the combination of:

a) a cementing valve having a cement flow channel from an internal pipe bore into a surrounding well annulus, said flow channel being opened by a fluid pressure displaced first sleeve element and closed by a fluid pressure displaced second sleeve element;

b) a fluid pressure engaged well annulus barrier surrounding said pipe bore and displaced along said pipe bore from said cementing valve;

c) a production valve positioned along said pipe bore from said annulus barrier in a direction opposite from said cementing valve, said production valve having a rupture opened flow channel from said surrounding well annulus into said pipe bore; and d) a pipe bore a-plug seat positioned along said pipe bore from said production valve in a direction opposite from said annulus barrier.

2. A well completion tool as described in claim 1 wherein said cementing valve, well annulus barrier, production valve and plug seat are serially aligned toward the well bottom.

3. A well completion tool as described in claim 1 wherein said combination further comprises a production packer positioned along said pipe bore from said cementing valve in a direction opposite from said annulus barrier.

4. A well completion tool as described by claim 1 wherein said cementing valve further comprises a closure plug seat positioned in said pipe bore along a direction from said cement flow channel opposite of said well annulus barrier.

5. A well production string comprising a production tube having an internal flow bore, said production tube suspending the operative assembly of:

a) a cementing valve having a cement flow channel from an internal flow bore into a surrounding well annulus, said flow channel being opened by a fluid pressure displaced first sleeve element and close by a fluid pressure displaced second sleeve element;

b) a fluid pressure expanded well annulus barrier surrounding said production tube and displaced along said production tube from said cementing valve;

c) a production valve positioned along said production tube from said annulus barrier in a direction opposite from said cementing valve, said production valve having a rupture opened flow channel from said surrounding well annulus into internal flow bore; and d) a pipe bore plug seat positioned along said pipe bore from said production valve in a direction opposite from said annulus barrier.

6. A well production string as described in claim 5 further comprising a production packer positioned along said flow bore from said cementing valve in a direction opposite from said annulus barrier.

7. A well production string as described in claim 5 further comprising a well fluid production screen operatively positioned along said flow bore from said plug seat in a direction opposite from said production valve.

8. A well production string as descried by claim 5 wherein said production tube further comprises a closure plug seat positioned in said internal flow bore from said cement flow in a direction opposite from said annulus barrier.

* * * * *